US005500104A

United States Patent [19]

Wang

[11] Patent Number: 5,500,104

[45] Date of Patent: Mar. 19, 1996

[54] MONO-POLAR PRE-FILTER ELECTROLYZER WITH VERTICAL POWER-SUPPLY RODS

[76] Inventor: Guo C. Wang, Mulan XiaoquNo.3721, Qizheng Street, Nangang District, Harbin, Heilongjiang Province, China

[21] Appl. No.: 409,055

[22] Filed: Mar. 23, 1995

[30] Foreign Application Priority Data

Mar. 23, 1994 [CN] China ..... 94 1 03112.8

[51] Int. Cl.[6] ..... C25B 9/00; C25B 11/03

[52] U.S. Cl. ..... 204/253; 204/257; 204/258

[58] Field of Search ..... 204/252–258, 204/263–266, 284, 290 R

[56] References Cited

U.S. PATENT DOCUMENTS

| | | | |
|---|---|---|---|
| 3,783,122 | 1/1974 | Sato et al. | 204/253 X |
| 4,378,286 | 3/1983 | Eng et al. | 204/257 |
| 4,459,196 | 7/1984 | Iijima et al. | 204/258 |
| 5,082,543 | 1/1992 | Gnann et al. | 204/257 X |

*Primary Examiner*—Donald R. Valentine

*Attorney, Agent, or Firm*—Sughrue, Mion, Zinn, Macpeak & Seas

[57] ABSTRACT

A mono-polar pre-filter electrolyzer comprises a plurality of cathode elements, each of which is composed of a cathode element receiver and a cathode screen; a plurality of anode elements, which are arranged with the cathode elements alternately and face to face, and each of which is composed of an anode element receiver, a conductive anode frame screen having an inner circumferential surface and an outer circumferential surface and received in the anode element receiver, and power-supply rods positioned longitudinally in the conductive anode frame screen with spaces from the inner circumferential surface of the anode frame screen; a plurality of independent membranes, which each are positioned between one anode element and one cathode element arranged face to face; a plurality of tension rods, which pass through all above components and fix them together; an anode bus, which is positioned at the bottom of the electrolyzer; the power-supply rods extend downward from the anode element receivers to electrically connect with the anode bus so that an electric current can be provided in the rods; and a cathode bus, which is mounted at one side of the electrolyzer and electrically connects with the cathode elements.

9 Claims, 6 Drawing Sheets

MONO-POLAR PRE-FILTER ELECTROLYZER WITH VERTICAL POWER-SUPPLY RODS

INTRODUCTION

The present invention relates to an apparatus which is employed to electrolyze a solution of alkali metal chloride to produce alkali and chlorine, and more particularly to a mono-polar pre-filter electrolyzer.

BACKGROUND

Various electrolyzers have been employed in chlor-alkali industry. In a diaphragm process, a deposition. diaphragm electrolyzer is commonly used. In this electrolyzer, power-supply rods are mounted vertically and its diaphragm is attached on a cathode screen by means of deposition, which has disadvantage that the diaphragm has lower strength, poor surface flatness, and uneven distribution of mass construction and results in lower content of alkali and higher content of chloride in a cathode electrolyte.

A membrane process develops fast since 1980s and has a tend to replace the prior diaphragm process with the advantages that this membrane process has a lower energy-consuming and that the product manufactured thereby can meet not only general requirement but also special requirement such as in the artificial fiber industry. However, high price and vulnerability of an ion-exchange membrane used in the membrane process result in a high requirement of the machining precision of the electrolyzer used therein.

Generally, a mono-polar pre-filter electrolyzer is one that used in the membrane process, in which horizontal or inclined power-supply rods are provided or no rods are provided. The electrolyzer has disadvantages of high manufacturing cost and can not be obtained by reforming the prior deposition diaphragm electrolyzer. Therefore, the replacement of the deposition diaphragm electrolyzer with this electrolyzer shall be finished in one time after whole system stops operating when a chlor-alkali manufacturer converts from the diaphragm process to the membrane process, which means that such replacement can not go on progressively as the system is operating.

The conventional mono-polar pre-filter electrolyzer with power-supply rods also has the disadvantages that the number of its horizontal or inclined power-supply rods has to be increased when a much higher electrolyzer is desired, which results in higher resistance to an up and down circulation of fluid in the electrolyzer, and that it requires larger floor area to site considering the difficulty of the increase of its height. A prior technology to convert the deposition diaphragm electrolyzer to the electrolyzer used in the membrane process is to reform the deposition diaphragm electrolyzer to a tank type membrane electrolyzer, but both working and assembly of the tank type membrane electrolyzer can not reach higher precision. In addition, this tank type electrolyzer consumes more membranes up to 40–150% and its current density is lower to 20–60% in operation than the conventional mono-polar pre-filter electrolyzer.

British patent No. UK 8103008 discloses an electrolyzer without power-supply rods used in the membrane process. Because the electrolyzer has no power-supply rods, its interior current route can not be longer than 25 cm, resulting in a restricted dimension of the anode. In order that the dimension of the anode is not restricted any more, Chinese patent No. 91101030.0 (publishing date: Sep. 25th, 1991) discloses an electrolyzer which has horizontal power-supply rods connecting with a bus to transmit electric current into the electrolyzer. Chinese patent No. 9010777.1 (publishing date: Mar. 13rd, 1991) discloses another electrolyzer which has horizontal and inclined power-supply rods. However, the power-supply rods arranged in this manner cause a higher resistance to the circulation of gases produced in electrolysis reaction. Therefore, the electrolyzer has to be added with some accessories to form passageway which is used for fluid circulation, which results in difficulty in increasing the height of the electrolyzer. Moreover, The above electrolyzers used in the membrane process are not able to obtain by reforming the prior deposition diaphragm electrolyzers when the diaphragm process is converted to the membrane process. In addition, the chlor-alkali manufacturer can not replace the electrolyzers during the system is operating.

An electrolyzer used in the membrane process and obtained from the deposition diaphragm electrolyzer is disclosed in Chinese Patent CN 86105810 A (publishing date: Feb. 18th, 1987), and its improvement is described in <<China Chlor-alkali>> No. 5, 1993. However the electrolyzer disclosed therein is a mono-polar tank type rather than the mono-polar pre-filter type. Because the tank type still has a box constitution similar to that of the deposition diaphragm electrolyzer, the membrane needs adhering to be in a bag shape. As a result, the membrane consumes more and the operating current density is 2000–2500 $A/M^2$ which is lower, and the electrolyzer is worse than that of the mono-polar pre-filter type on the record of operation and economy indicator.

It is an object of the present invention to overcome the disadvantages of prior art and provides a mono-polar pre-filter electrolyzer with vertical power-supply rods. When the electrolyzer is applied in the membrane process, its all records of operation, technology and economy are similar to those of the conventional mono-polar pre-filter electrolyzer. Moreover, the increase of its height is not restricted and it can be obtained by reforming the prior deposition diaphragm electrolyzer.

It is a further object of the present invention to provide an electrolyzer which can replace from the deposition diaphragm electrolyzer one by one as the system is under operation, when the deposition diaphragm process is converted into the membrane process.

SUMMARY OF THE INVENTION

To this end, according to a first aspect of the present invention, a mono-polar pre-filter electrolyzer is provided and comprises:

- a plurality of cathode elements, each of which is composed of a cathode element receiver and a cathode screen;
- a plurality of anode elements, which are arranged with the cathode elements alternately and face to face, and each of which is composed of an anode element receiver, a conductive anode frame screen having an inner circumferential surface and an outer circumferential surface and received in the anode element receiver, and power-supply rods positioned longitudinally in the conductive anode frame screen with spaces from the inner circumferential surface of the anode frame screen;
- a plurality of independent membranes, which each are positioned between one anode element and one cathode element arranged face to face;
- a plurality of tension rods, which pass through all above components and fix them together;

an anode bus, which is positioned at the bottom of the electrolyzer; the power-supply rods extend downward from the anode element receivers to electrically connect with the anode bus so that an electric current can be provided in the rods; and a cathode bus, which is mounted at one side of the electrolyzer and electrically connects with the cathode elements.

According to a second aspect of the present invention, a mono-polar pre-filter electrolyzer is provided and comprises:

a plurality of cathode elements, each of which has an inlet and an outlet of a solution of electrolyte and gases produced and is composed of a cathode element receiver and a cathode screen; an activity coating is provided on one side of said cathode screen and strength ribs are provided on the other side thereof;

a plurality of anode elements, which are arranged with the cathode elements alternately and face to face, and each of which has an inlet and an outlet of a solution of electrolyte and gasses produced and is composed of an anode element receiver with a hollow center, a conductive anode frame screen having an inner circumferential surface and an outer circumferential surface and received in the hollow center of the anode element receiver, and power-supply rods positioned longitudinally in the conductive anode frame screen in such a manner that they space from the inner circumferential surface of the anode frame screen; an activity coating is provided on the outer circumferential surface of the anode frame screen;

a plurality of independent membranes, which each are positioned between one anode element and one cathode element arranged face to face;

a plurality of tension rods, which pass through all above components and fix them together;

an anode bus, which is positioned at the bottom of the electrolyzer; the power-supply rods extend downward from the anode element receivers to connect electrically with the anode bus so that an electric current can be provided in the rods; and a cathode bus, which is mounted at one side of the electrolyzer and connects electrically with the cathode elements.

Preferably, the membranes are ion-exchange ones.

Preferably, gaskets are provided between the anode element receivers and the membranes and between the cathode element receivers and the membranes.

Preferably, the anode frame screens further comprise inner partition screens to define longitudinal passages so that the power-supply rods are received.

Preferably, the longitudinal passages have a cross section in a rectangular shape.

Alternatively , the inner partition screens each have a cross section in a trapezoid shape to position the power-supply rods.

Preferably, a conductive clip connected with the cathode bus by a flexible copper cable is provided to achieve the electrical connection between the cathode bus and each of the cathode screens.

Preferably, a thin screen whose surface is coated with an activity coating is attached on the outer circumferential surface of each of the anode frame screens.

The working principle of the electrolyzer according to the present invention is described below.

After a solution of electrolyte enters into the anode element and the power-supply rods are applied with direct electric current, chlorions discharge on the anodic surface and produce chlorine and hydrions discharge on the cathodic surface and produce hydrogen. The remaining solution then flows into the cathode element and out therefrom as aqueous alkali. The membrane which is between the anode and the cathode can separate the products of two electrodes. If the membrane is ion-exchange one, it can prevent most of the chlorion and water from flowing from the anode to the cathode. As a result, the concentration of the aqueous alkali is higher and the content of chlorion is lower.

The present invention has following advantages:

1. Only the height rather than the number of the rods arranged vertically needs increasing, when a much higher electrolyzer is required, and the rods arranged in such a way can provide a circulating passage-way with less resistance to fluid circulation. Thus the floor area occupied by the electrolyzer is reduced.

2. When the chlor-alkali manufacturer converts the diaphragm process to the membrane process, the mono-polar pre-filter electrolyzer of the present invention can be obtained by reforming the prior deposition diaphragm electrolyzer because the vertical power-supply rods and the anode frame screen of the present invention can be obtained by reforming respectively the power-supply rods and titanium anode screen of the prior deposition diaphragm electrolyzer. In the present invention, because the lower portions of vertical power-supply rods extend to connect with the anode bus, the anode bus and the ground plate of the prior deposition diaphragm electrolyzer can be used, and because the portions of the cathode screens on the cathode element receivers of the present invention extend outward from the cathode element receivers to connect with the cathode bus at one side of the electrolyzer, the cathode bus of deposition can be maintained to use too. In addition, the reformed electrolyzer's installation dimension, the size and means for connecting with a system circuit board are the same as those of the prior deposition diaphragm electrolyzer, and the prior deposition electrolyzer can be replaced by the present electrolyzer in a similar manner to its normal replacement under the condition that the system is under operation. If the mono-polar pre-filter electrolyzer of the present invention, which has vertical power-supply rods, is used when the diaphragm process is converted to the membrane process, the conversion cost can be reduced.

3. Because the electrolyzer of the present invention is made of a plurality of smaller components, it is easy to assemble and fabricate with a high precision. Because the number of components used in each electrolyzer can be changed to get different capacities and current densities, the electrolyzer of the present invention overcomes the disadvantages of the tank type electrolyzer, such as more membrane consumption and lower current density.

Further object and advantages of the invention will appear from the following description taken together with the accompanying drawings

BRIEF DESCRIPTION OF THE DRAWINGS

FIGS.1 to 3 show a preferred embodiment of the monopolar pre-filter electrolyzer with vertical power-supply rods according to the present invention, which is used in the membrane process. Numeral 1 indicates an anode bus, numeral 2 indicates a ground plate, numeral 3 indicates a insulator, numeral 4 indicates an end cathode element receiver, numeral 5 indicates an anode element receiver, numeral 6 indicates a tension rod, numeral 7 indicates an anode gasket, numeral 8 indicates a conductive anode frame screen, numeral 9 indicates a membrane (the membrane used in the embodiment is an ion-exchange membrane), numeral 10 indicates a first cathode gasket, numeral 11 indicates a cathode screen, numeral 12 indicates a second cathode gasket, numeral 13 indicates a cathode element receiver, numeral 14 indicates a cathode bus, numeral 15 indicates an insulation pad, numeral 16 indicates a vertical power-supply rod.

The anode element of the present invention as shown in FIGS. 1, 2, 3, 4A, 4B and 6 is composed of the anode element receiver 5, the anode frame screen 8 and the power-supply rods 16. The anode element receiver 5 is made of metal titanium or other anticorrosive materials such as fluoride plastic and special rubber. The anode element receiver 5 has a rectangular shape With a hollow central portion. The anode frame screen 8 with the power-supply rods 16 is arranged in the central portion of the anode element receiver 5.

Figure 4B:
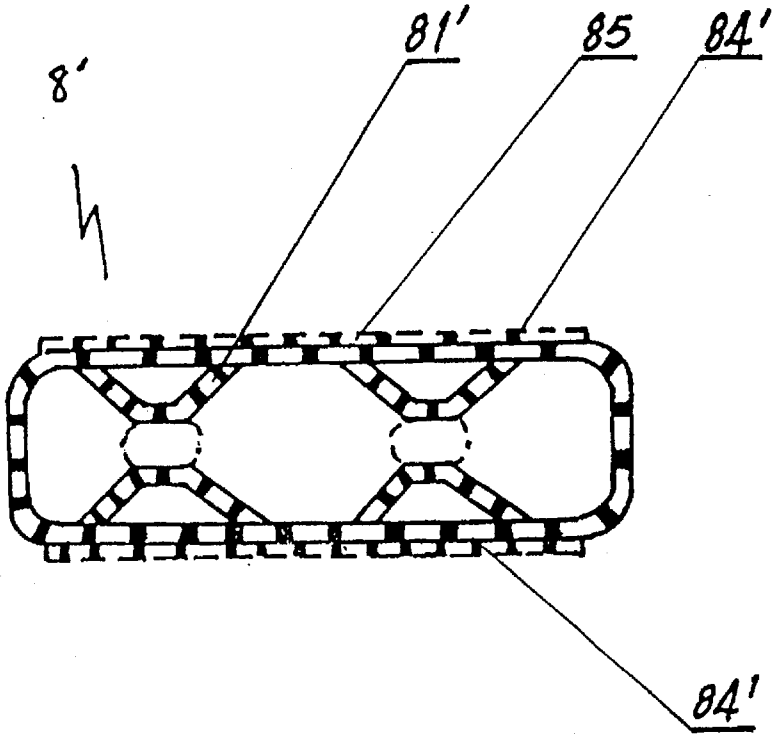
FIGS. 4A and 4B are sectional views of the anode frame screen, in which two constructions are shown for rods with different shapes.
Figure 4A:
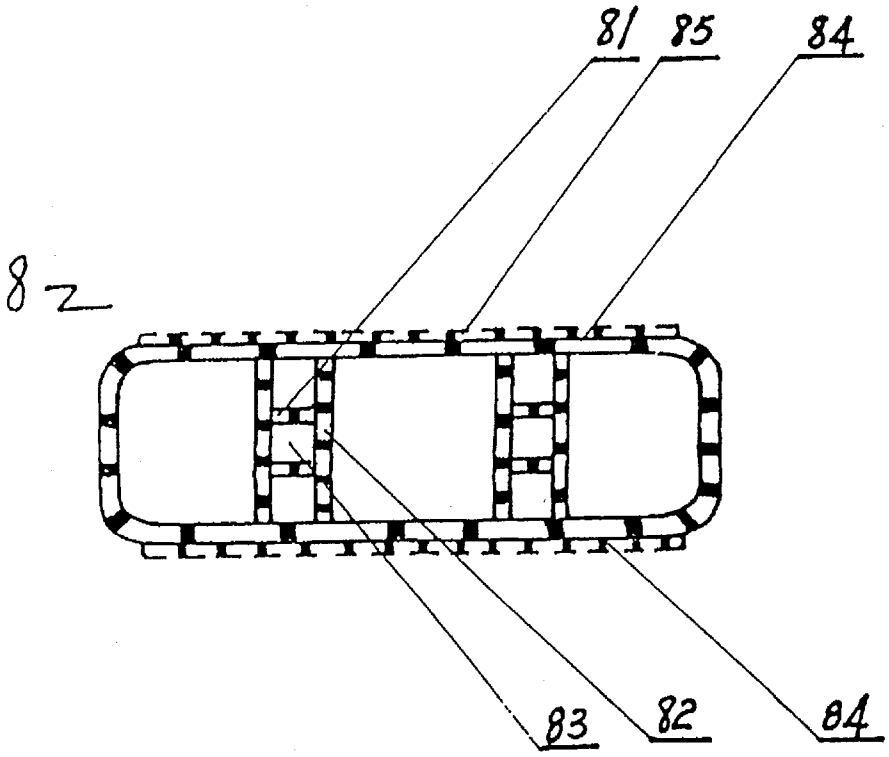

The constitution of the anode frame screen 8 is shown in FIG. 4A and 4B, and two embodiments of frame screen constitution are shown in these figures. The shape of the frame screen 8, 8' is a cuboid. The four outer walls of the cuboid are made of materials (usually metal titanium) which is conductive, anticorrosive to chlorine and in gauze shape or in perforate plate shape.

As shown in FIG. 4A, the interior partition screens 81, 82 are positioned longitudinally in the cuboid and define longitudinal passages 83 to contain and fix the power-supply rods 16. The constitution as shown in FIG. 4A is used to contain power-supply rods 16 with rectangular cross sections. When the shape of the cross sections of the power-supply rods 16 is shown by dot dash line in FIG. 4B, the shape of the cross sections of the interior partition screens is shown as numeral 81'. It is understood that the interior partition screens 81, 82, 81' are arranged to keep certain spaces between the power-supply rods 16 and the inner circumferential surface of the screen 8, 8' in order to assure an effective up and down circulation of fluid.

There should be an activity coating on the outer circumferential surface of the screen 8, 8'. The activity coating should be coated on the outer circumferential surface of the screen 8, 8' directly, but a thin screen, perforate plate or gauze 85, 85' coated with the activity coating may be provided to attach on the main working surface 84, 84' of the screen 8, 8' in order to obtain easy maintenance of-the coating.

The end cathode element receiver 4 is made of steel or cast iron and is also a rectangular receiver with one side closed, and its inner surface (the surface which contacts with the solution of electrolyte directly) is covered by materials anticorrosive to alkali, such as nickel, stainless steel, or heat-resisting and alkali-resisting plastic.

Figure 1:
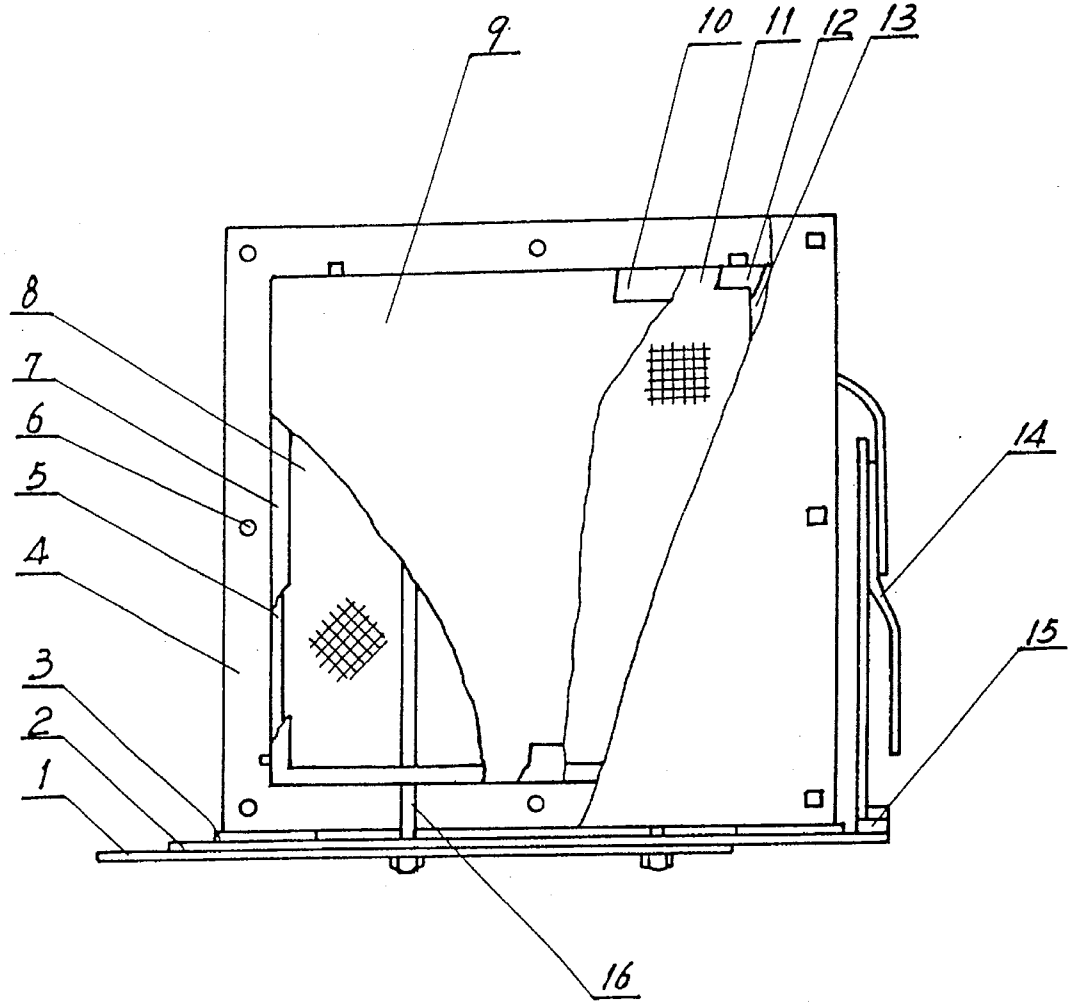
FIG. 1 is a front view of a mono-polar pre-filter electrolyzer with vertical power-supply rods according to an embodiment of the present invention, in which some components are broken for clear show.
Figure 2:
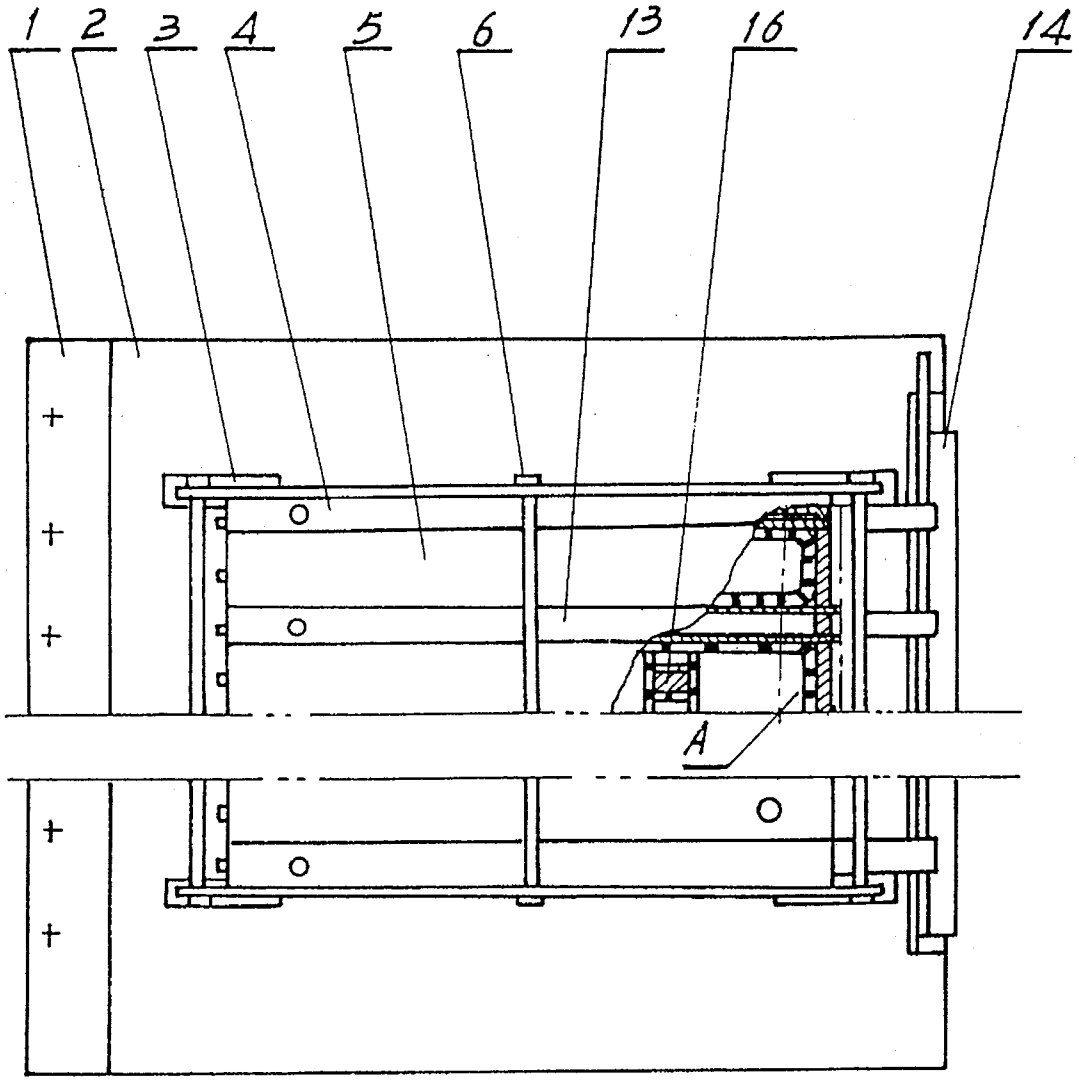
FIG. 2 is a top view of the mono-polar pre-filter electrolyzer with vertical power-supply rods according to the present invention, in which some components such as the anode gasket and so on are omitted for clear show.
Figure 3:
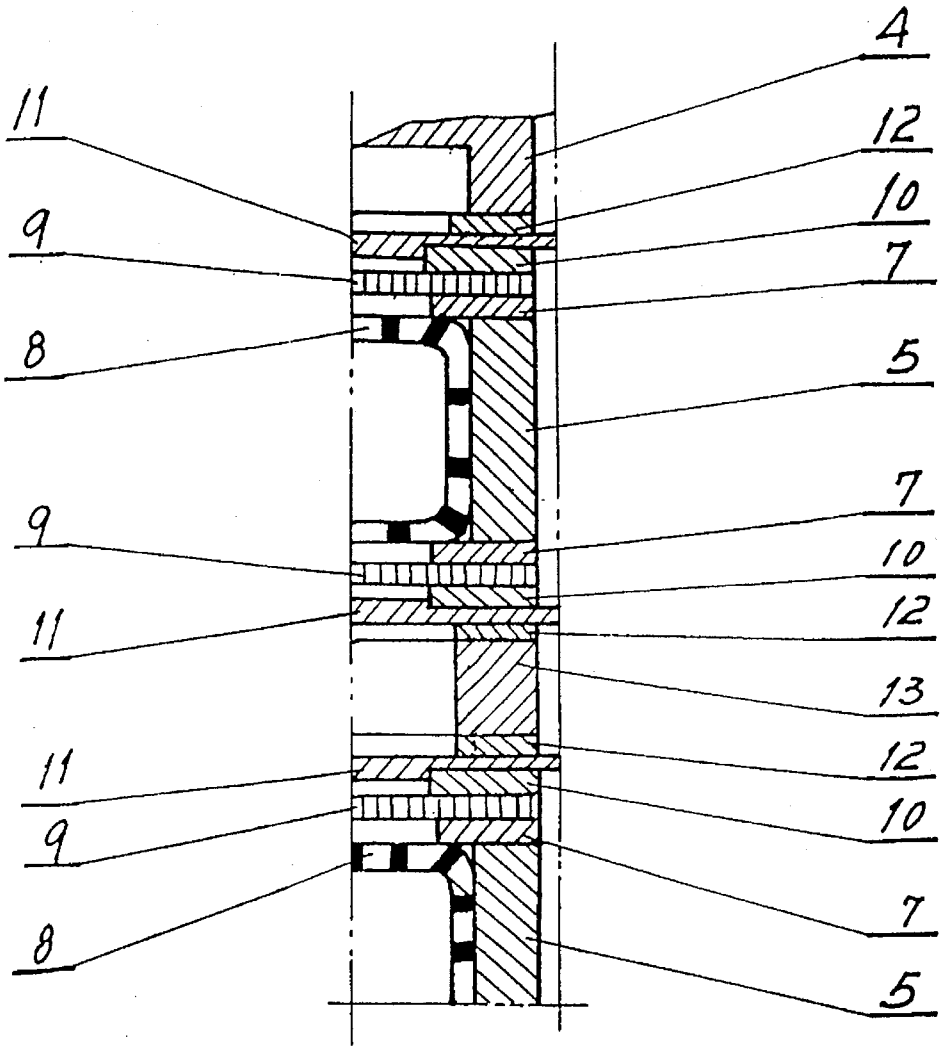
FIG. 3 is an enlarged view of area indicated by A in FIG. 2.

As shown in FIGS. 1 to 3, the cathode screen 11 is positioned to be adjacent to the end cathode element receiver 4 and is made of conductive materials such as copper, nickel, and stainless steel. It includes a rectangular edge without holes and a central portion which is made of a perforate plate or gauze. A protruding portion of the rectangular edge extends therefrom at one side for connection with the cathode bus 14 (see FIG. 5). If the cathode screen 11 is not made of metal nickel, its surface must be coated with metal nickel. At one side of the center portion of the screen 11 is provided with the activity coating and at the other side (the side which is attached on the end cathode element receiver 4 tightly) is provided with strengthening ribs. The second cathode gasket 12 is positioned between the cathode screen 11 and the end cathode element receiver 4 to assure them to join tightly. The cathode screen 11 and the end cathode element receiver 4 can be made as a single component to constitute an integral cathode element. The first cathode gasket 10 is mounted at the other side of the cathode screen 11. The ion-exchange membrane 9 is the next one to be adjacent to the gasket 10. It shall be noted that the membrane used in the present invention is in sheet shape and is an independent component from others, no matter what kind of membrane, ion-exchange one or others it is. This arrangement and structure of the membrane of the present invention is in conformity with that of the conventional electrolyzer used in the membrane process, so as to achieve the same effect as the conventional membrane electrolyzer. The anode gasket 7 is arranged at the other side of the ion-exchange membrane 9. An anode element is positioned to be adjacent to the gasket 7. The anode element is composed of the anode element receiver 5, the anode frame screen 8 and the vertical power-supply rods 16 which are positioned in the anode frame screen 8, when the electrolyzer of the present invention is finished assembling, the membrane 9 is forced to adjoin to one side surface of the anode frame screen 8 extending out from the anode frame screen receiver 5. The anode gasket 7, the ion-exchange membrane 9, the first cathode gasket 10, the cathode screen 11 and second cathode gasket 12 can be positioned in turn in above manner at the other side of the anode element. The cathode element receiver 13 is positioned at the other side of the second cathode gasket 12. Both the cathode element receiver 13 and the end cathode element receiver 4 are made of alkali-resisting material. Compared with the constitution of the end cathode element receiver 4, the cathode element receiver 13 is only a rectangular frame with a hollow central portion. The receiver 13 can also be integrated with a cathode screen to form a single cathode element. The second cathode gasket 12, the cathode screen 11, the first cathode gasket 10, the ion-exchange membrane 9, the anode gasket 7 and a second anode element can be positioned in turn at the other side of the cathode element receiver 13. Such arrangement (begins with positioning the anode element for the first time and ends with positioning the anode element again) is repeated and the repeating times thereof is determined by the requirement of the electrolyzer's capacity and current density. When the electric current is 45,000 A, the electric current density is 3000 $A/m^2$ and the surface area of each anode frame screen 8 is 1 $m^2$ this arrangement can be repeated 14 times. The whole electrolyzer is finishing with an end anode element receiver 4 (FIG. 2). After the end anode element receiver 4 is positioned properly, the tension rods 6 pass through all above components and fix them to be an extremely close integration, and the extremely close integration is then positioned on the ground plate 2. The insulator 3 should be clamped between the ground plate 2 and the integration. The lower portions of the vertical power-supply rods 16 extend downward from the anode elements to connect with the anode bus 1. The cathode bus 14 is vertically positioned on the ground plate 2 and the insulation pad 15 is positioned between them. The cathode bus 14 is electrically connected with the cathode screens 11.

Figure 5:
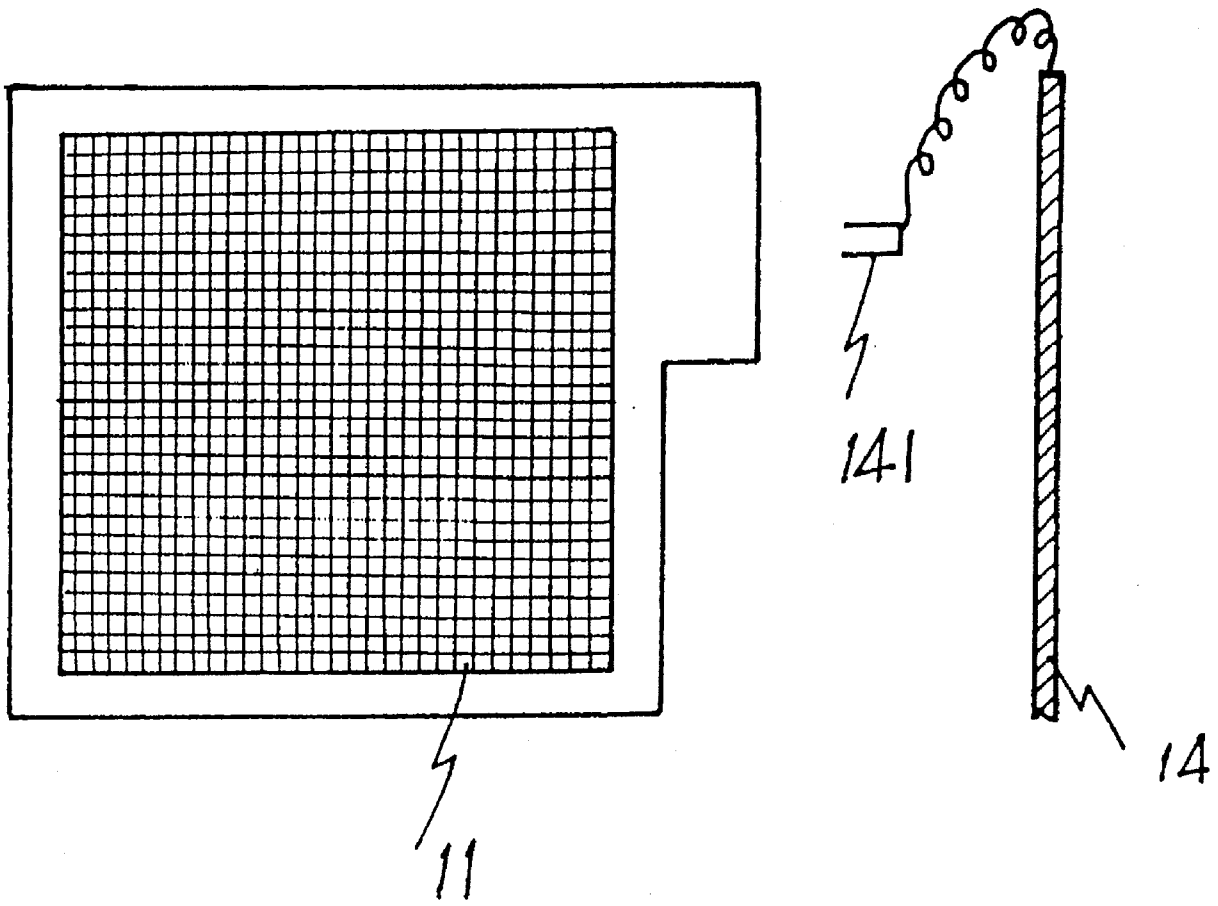
FIG. 5 is a schematic view showing the coupling of the cathode bus with a cathode screen.
Figure 6:
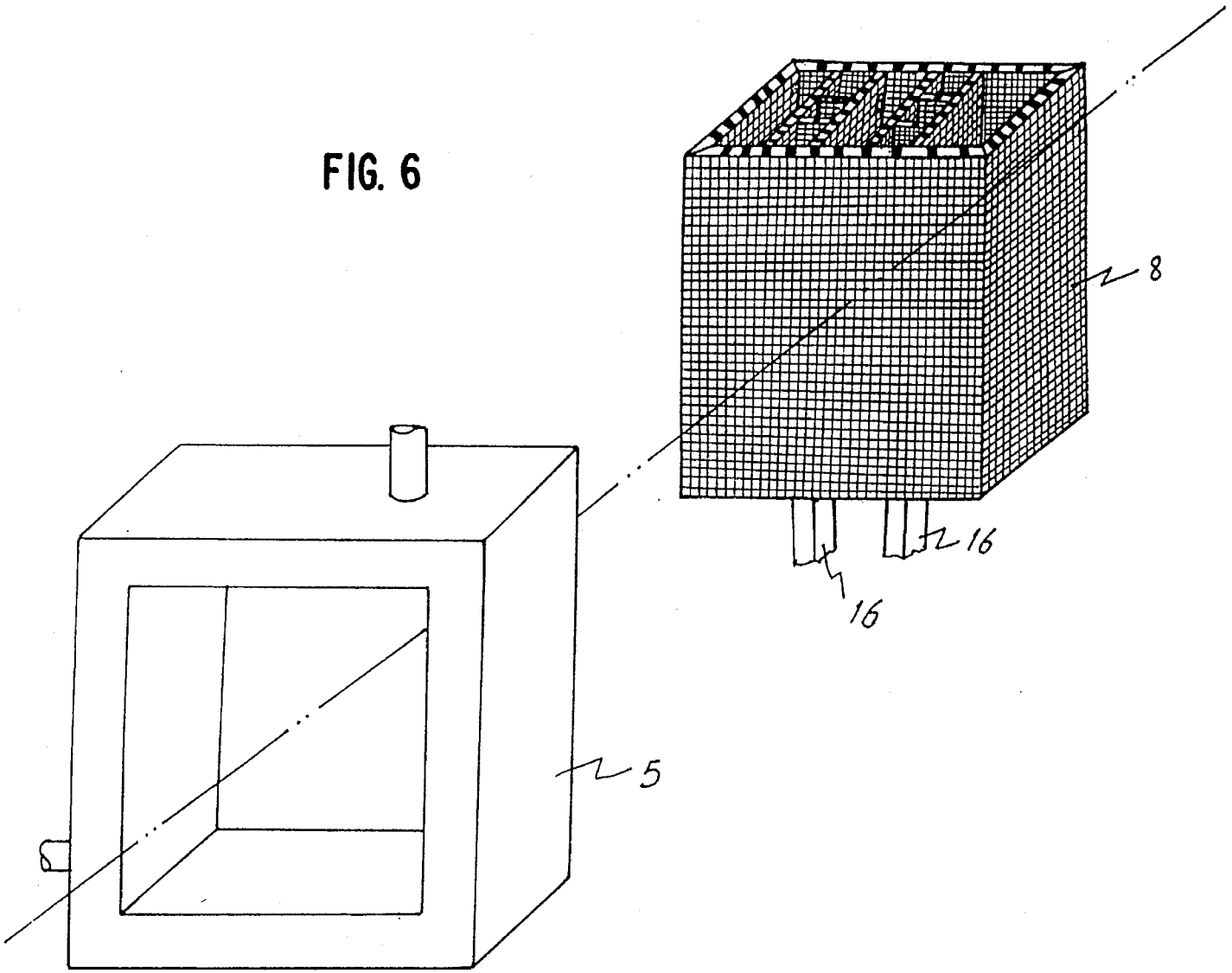
FIG. 6 is an exploded view of the anode element.

In addition, in the present invention, as shown in FIG. 5, the electric connection between one cathode screen 11 and the cathode bus 14 is achieved in such a manner that a conductive anchorage clip 141, which is connected with the cathode bus 14 through a flexible copper cable, clamps on the cathode screen 11 to achieve the electric connection. Moreover, as shown in FIG. 3, it is easy to achieve the electric connection between the cathode screen 11 and the cathode bus 14, because of the protruding portion at the side of each cathode screen 11 (see the right side of FIG.3).

The thickness of the anode gasket 7 and the first cathode gasket 10 are determined by the specification of the ion-exchange membrane 9 in order to obtain different required gaps between the surfaces of the anode element and the cathode element.

Under the condition that the content of Nacl in feeding brine is 300 g/l, that the ion-exchange membrane 9 is cation-exchange membrane NX-962 (produced by E. I. Du Pont Co., Delaware, U.S.A.), that the temperature is 90° C. and that the electric current density is 3,000 A/m$^2$, the content of NaOH in the produced aqueous alkali is more than 30%. When the held pressure of fluid at the upper portions of the end cathode receiver and the cathode receiver is 0.5–9 KPa higher than that of fluid at the upper portion of the anode receiver, the voltage of cell is 3.0 V and the current efficiency is not less than 95.5%.

Under the condition that the ion-exchange membrane 9 is cation-exchange membrane NX-90209 (produced by E. I. Du Pont Co., Delaware, U.S.A.) and that the thickness of the first cathode gasket is changed correspondingly, the voltage of cell is 3.1 V and current efficiency is not less than 96.0%.

Under that condition that the end cathode element receiver 4, the cathode screen 11 and the cathode element receiver 13 are made of carbon steel, that the membrane 9 is an anticorrosive and osmophilic membrane without ion-exchange effect and is 1–2 mm in thickness, that the thickness of the anode gasket 7 is increased to 1–3 mm, that the held pressure of fluid at the upper portion of the anode receiver 5 is 0.5–3 KPa higher than that of the end cathode receiver 4 and the cathode receiver 13, that the content of NaCl in the brine fed into the anode element 5 is more than 310 g/l, that the content of NaOH of aqueous alkali is 10–12%, that the current density is 2,000–2,500 A/m$^2$ , and that the temperature is 95° C., the voltage of cell is 3.1–3.3 V and the current efficiency is not less than 96.0%.

While the description of the invention has been given with respect to preferred embodiments, it is not to be constructed in a limited sense. Variation and modification will occur to those skilled in the art. Reference is made to the appended claimed for a definition of the invention.

I claim:

1. A mono-polar pre-filter electrolyzer, which comprises:

a plurality of cathode elements, each of which is composed of a cathode element receiver and a cathode screen;

a plurality of anode elements, which are arranged with the cathode elements alternately and face to face, and each of which is composed of an anode element receiver, a conductive anode frame screen having an inner circumferential surface and an outer circumferential surface and received in the anode element receiver, and power-supply rods positioned longitudinally in the conductive anode frame screen with spaces from the inner circumferential surface of the anode frame screen;

a plurality of independent membranes, which each are positioned between one anode element and one cathode element arranged face to face;

a plurality of tension rods, which pass through all above components and fix them together;

an anode bus, which is positioned at the bottom of the electrolyzer; the power-supply rods extend downward from the anode element receivers to electrically connect with the anode bus so that an electric current can be provided in the rods; and a cathode bus, which is mounted at one side of the electrolyzer and electrically connects with the cathode elements.

2. An electrolyzer as claimed in claim 1, wherein a thin screen whose surface is coated with an activity coating is attached on the outer circumferential surface of each of the anode frame screens.

3. A mono-polar pre-filter electrolyzer, which comprises:

a plurality of cathode elements, each of which has an inlet and an outlet of a solution of electrolyte and gases produced and is composed of a cathode element receiver and a cathode screen; an activity coating is provided on one side of said cathode screen and strength ribs are provided on the other side thereof;

a plurality of anode elements, which are arranged with the cathode elements alternately and face to face, and each of which has an inlet and an outlet of a solution of electrolyte and gasses produced and is composed of an anode element receiver with a hollow center, a conductive anode frame screen having an inner circumferential surface and an outer circumferential surface and received in the hollow center of the anode element receiver, and power-supply rods positioned longitudinally in the conductive anode frame screen in such a manner that they space from the inner circumferential surface of the anode frame screen; an activity coating is provided on the outer circumferential surface of the anode frame screen;

a plurality of independent membranes, which each are positioned between one anode element and one cathode element arranged face to face;

a plurality of tension rods, which pass through all above components and fix them together;

an anode bus, which is positioned at the bottom of the electrolyzer; the power-supply rods extend downward from the anode element-receivers to connect electrically with the anode bus so that an electric current can be provided in the rods; and a cathode bus, which is mounted at one side of the electrolyzer and connects electrically with the cathode elements.

4. An electrolyzer as claimed in claim 1 or 3, wherein the membranes are ion-exchange ones.

5. An electrolyzer as claimed in claim 1 or 3, wherein gaskets are provided between the anode element receivers and the membranes and between the cathode element receivers and the membranes.

6. An electrolyzer as claimed in claim 1 or 3, wherein the anode frame screens further comprise inner partition screens to define longitudinal passages so that the power-supply rods are received.

7. An electrolyzer as claimed in claim 6, wherein the longitudinal passages have a cross section in a rectangular shape.

8. An electrolyzer as claimed in claim 6, wherein the inner partition screens each have a cross section in a trapezoid shape to position the power-supply rods.

9. An electrolyzer as claimed in claim 1 or 3, wherein a conductive clip connected with the cathode bus by a flexible copper cable is provided to achieve the electrical connection between the cathode bus and each of the cathode screens.

* * * * *